United States Patent [19]

Fukushima et al.

[11] Patent Number: 4,467,243

[45] Date of Patent: Aug. 21, 1984

[54] ELECTRON GUN

[75] Inventors: Masakazu Fukushima, Tokyo; Masanori Maruyama, Kokubunji; Shigeru Ehata, Mobara; Chihaya Ogusu, Tokyo; Yukinao Isozaki, Machida, all of Japan

[73] Assignees: Hitachi, Ltd.; Nippon Hoso Kyokai, both of Tokyo, Japan

[21] Appl. No.: 315,869

[22] Filed: Oct. 28, 1981

[30] Foreign Application Priority Data

Oct. 29, 1980 [JP] Japan ..... 55-150649

[51] Int. Cl.[3] ..... H01J 29;46

[52] U.S. Cl. ..... 313/448; 313/460; 313/452

[58] Field of Search ..... 313/448, 449, 441, 446, 313/452, 460

[56] References Cited

U.S. PATENT DOCUMENTS 3,045,141 7/1962 Epstein et al. ..... 313/448
3,374,379 3/1968 Maruyama et al. ..... 313/448
3,873,878 3/1975 Odenthal ..... 313/449
3,894,261 7/1975 Corson ..... 313/449
3,928,784 12/1975 Weijland ..... 313/448 X

*Primary Examiner*—David K. Moore
*Assistant Examiner*—K. Wieder
*Attorney, Agent, or Firm*—Antonelli, Terry & Wands

[57] ABSTRACT

An electron gun is disclosed which includes a thermionic cathode for emitting an electron beam, a grid having a first aperture for controlling the diameter of the electron beam, and an anode having a second aperture for catching a part of the electron beam having passed through the first aperture; and in which the diameter of the first aperture is smaller than or equal to the diameter of the second aperture, and the grid and the anode are applied with positive potentials relative to a cathode potential, for example, with a voltage of 5 to tens of volts and a voltage of 100 to 500 volts, respectively, to form a uniform axial field between the grid and the anode, thereby generating a laminar flow electron beam having a constant current density.

11 Claims, 7 Drawing Figures

ELECTRON GUN

BACKGROUND OF THE INVENTION

The present invention relates to an electron gun for use in a television camera tube, and more particularly to a diode type electron gun for generating a laminar flow electron beam.

Such an electron gun has been proposed in a Japanese Patent Application Kokai (Laid-open) No. 39869/75 (corresponding to U.S. Pat. No. 3,894,261). The electron gun includes, as shown in FIG. 1, a thermionic cathode 21, a heater 22, a grid 23, an anode 24, and a disk 25 which is electrically connected with the grid 23 and has an aperture 26. In the above-mentioned electron gun, the grid 23 (including the disk 25) and the anode 24 are applied with positive potentials relative to a cathode potential. Such an electron gun is called the diode type electron gun, and performs a diode operation. Specifically, in this electron gun, no electron lens is formed between the thermionic cathode 21 and the grid 23 so that an electron beam emitted from the thermionic cathode 21 does not form any crossover, and the diameter of the electron beam is restricted by the aperture 26 made in the grid 23 to generate an electron beam 20 having a small diameter. Further, an end of the aperture 26 which faces the thermionic cathode 21, is smaller in diameter than the other end, as shown in FIG. 2. That is, the aperture 26 has, in section, the form of a knife edge in order to prevent the diameter of the electron beam from being increased due to electrons scattered by the side wall of the aperture.

However, it is very difficult to make an aperture having such an ideal form as shown in FIG. 2. Further, since the electron beam emitted from the thermionic cathode includes electrons each of which has a velocity component perpendicular to the axis of electron gun, that is, parallel to a radial direction, it is impossible to reduce in a large degree the number of electrons scattered by the side wall of the aperture. Accordingly, in a television camera tube provided with an electron gun having such a structure as shown in FIG. 1, the spot size of the electron beam is increased due to the above-mentioned scattered electrons, especially when the electron beam is deflected to a corner on the scan area, and therefore the resolution at the corner on the scan area is considerably deteriorated.

Further, a Japanese Patent Application Kokai (Laid-open) No. 129871/79 (corresponding to British Patent Application Laid-open No. GB 2015817A and corresponding to U.S. application Ser. No. 877,080 filed on Feb. 13, 1978) has proposed an electron gun which is an application of the above-mentioned diode type electron gun, and in which an electron focusing lens having substantially no effect on the electron emission at a cathode is formed between a grid and an anode in order that an electron beam slightly converges to form a crossover. This electron gun includes, as shown in FIG. 3, a grid 23 (namely, a first anode) having a first aperture 26, and an anode 24 (namely, a second anode) having a second aperture 28. The anode 24 is partially closed with a disk 27 having the second aperture 28. The diameter of the first aperture 26 is at least twice as large as that of the second aperture 28, and the diameter of the first aperture 26 is made small appropriately. In this electron gun, the grid 23 is applied with a positive voltage of 10 to tens of volts and the anode 24 is applied with a positive voltage which is at least ten times as large as the voltage applied to the grid, that is, a positive voltage of at least 100 volts in order to form between the grid 23 and anode 24 a lens field which has substantially no effect on the electron emission at a cathode 21. Thus, an electron beam having passed through the first aperture 26 forms a crossover, and then the utilizing beam current and the divergent beam angle are controlled by the second aperture 28 having a diameter of about 0.05 mm. That is, an electron beam 20 having a small diameter is generated. In the above-mentioned electron gun, owing to the presence of the crossover, a group of electrons contained in the electron beam have an energy distribution which is for wider than an energy distribution determined by a cathode temperature, and therefore the capacitive signal lag is large.

SUMMARY OF THE INVENTION

An object of the present invention is to provide a diode type electron gun which generates an electron beam having a uniform energy distribution in the direction of the axis of electron gun in order to eliminate all of the above-mentioned drawbacks, and which is not only high but also uniform in resolution and small in lag (namely, after image) when used in a vidicon type television camera tube.

In order to attain the above and other objects, according to the present invention, there is provided an electron gun comprising a thermionic cathode for emitting an electron beam; a grid having a first aperture for controlling the diameter of the electron beam; and an anode having a second aperture for catching a part of the electron beam having passed through the first aperture, the diameter of the first aperture being smaller than or equal to the diameter of the second aperture, the grid and the anode being applied with positive potentials relative to a cathode potential, for example, with a voltage of 5 to tens of volts and a voltage of 100 to 500 volts, respectively, to form a uniform axial field between the grid and the anode. Such a uniform axial field between the grid and the anode generates a laminar flow electron beam having a constant current density.

In an electron gun having such a structure, an electron beam emitted from a cathode is extracted by a first aperture in a grid in such a manner that the diameter of the electron beam is restricted by the first aperture. The electron beam having passed through the first aperture contains both scattered electrons formed in the first aperture and electrons emitted from the cathode with a large velocity component in a radial direction. These electrons, however, are caught by a second aperture made in an anode, and therefore only electrons each having a small velocity component in a radial direction can pass through the second aperture. Further, in a diode type electron gun according to the present invention, electrons in the electron beam formed by the electron gun have a velocity distribution in the direction of the axis of electron gun whose width is substantially the same as that determined by a cathode temperature, since an electron beam emitted from the cathode does not form any crossover. As a result, in a television camera tube provided with such a diode type electron gun, the spot size of electron beam is kept constant. Accordingly, the above-mentioned tube is not only high but also uniform in resolution and small in lag as compared with a television camera tube provided with the conventional diode type electron gun.

DESCRIPTION OF THE PREFERRED EMBODIMENTS

Figure 1:
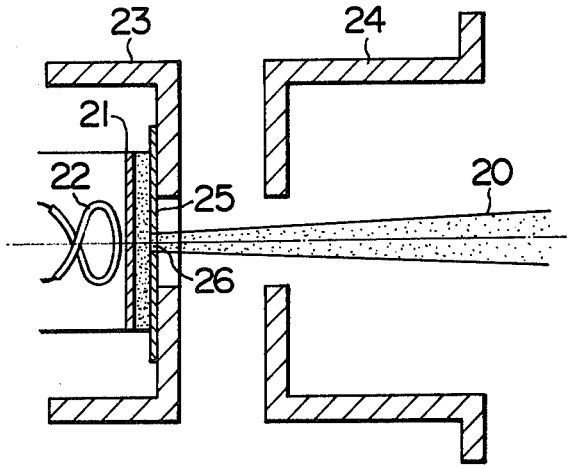
FIG. 1 PRIOR ART
FIG. 1 is a sectional view showing a conventional diode type electron gun.
Figure 2:
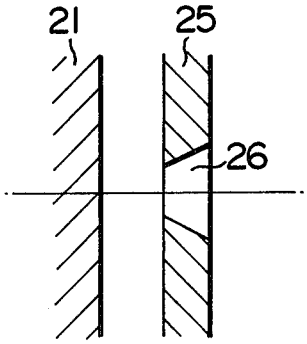
FIG. 2 PRIOR ART
FIG. 2 is an enlarged sectional view of a main part of the electron gun shown in FIG. 1.
Figure 3:
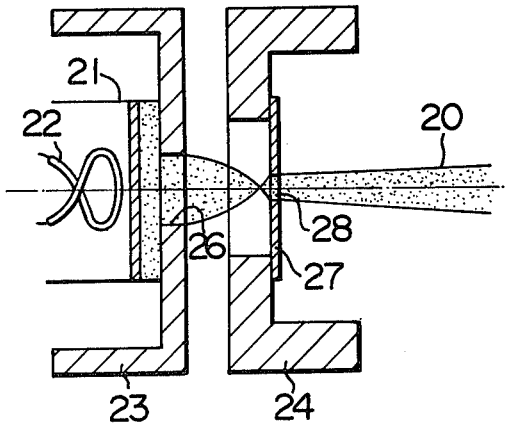
FIG. 3 PRIOR ART
FIG. 3 is a sectional view showing another conventional diode type electron gun.
Figure 4:
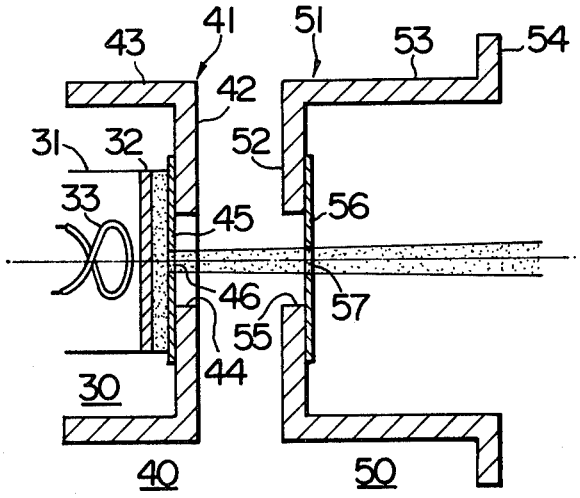
FIG. 4 is a sectional view showing an embodiment of an electron gun according to the present invention.

FIG. 4 shows, in section, an embodiment of an electron gun according to the present invention. Referring to FIG. 4, the embodiment is provided with a thermionic cathode 30 which includes a cylindrical sleeve 31 having a closed end 32 on the right side and a heater 33 placed in the cylindrical sleeve 31. The closed end 32 has a pellet made of an electron emissive material to form a planar cathode surface. The heater 33 generates heat necessary to emit electrons from the pellet of the thermionic cathode. A grid 40 and an anode 50 are arranged on one side of the thermionic cathode 30 in such a manner that they are spaced apart from each other, as shown in FIG. 4.

The grid 40 is made up of a cup-shaped electrode 41 and a circular disk 45. The cup-shaped electrode 41 has a plate portion 42 which is placed near the planar cathode surface in parallel to this surface, and a cylindrical portion 43 which is arranged concentrically with the cylindrical sleeve 31. The cylindrical portion 43 is larger in inner diameter than the sleeve 31, and is extended in the direction toward the thermonic cathode 30.The plate portion 42 has at a central part thereof a hole 44, the diameter of which is smaller than the diameter of the sleeve 31 adjacent to the hole 44. The disk 45 has a diameter which is larger than the diameter of the hole 44 made in the plate portion 42 and is smaller than the inner diameter of the cylindrical portion 43. The disk 45 is placed concentrically with the hole 44, on a surface of the plate portion 42 which faces the cathode surface, and is kept in electrical contact with the cup-shaped electrode 41. The disk 45 is made of a nonmagnetic material, and is smaller in thickness than the plate portion 42. The disk 45 has at a central part thereof a hole 46, which is arranged concentrically with the hole 44 of the plate portion 42 and is far smaller in diameter than the hole 44. The diameter of the hole 46 is smallest at a place near the cathode surface and is increased as the distance from the cathode surface is larger, to obtain a tapered hole. The hole 44 of the cup-shaped electrode 41 is partially closed with the disk 45 having the tapered hole 46. The hole 46 provides a first aperture in the grid 40.

The anode 50 is also made up of a cup-shaped electrode 51 and a disk 56. The cup-shaped electrode 51 includes a plate portion 52 which is placed near the plate portion 42 of the grid 40 approximately parallel to the plate portion 42, a cylindrical portion 53 which is arranged concentrically with the cylindrical portion 43 of the grid 40, has substantially the same inner diameter as the cylindrical portion 43, and is extended in a direction opposite to the cathode, and a lip portion 54 provided at the farthest place from the cathode 30. The plate portion 52 has at a central part thereof a hole 55, the diameter of which is substantially the same as the diameter of the hole 44 in the grid 40, and the center axis of which is coincident with the axis of the electron gun (indicated by a dot-dash line in FIG. 4). The disk 56 has a diameter which is larger than the diameter of the hole 55 made in the plate portion 52 and is smaller than the inner diameter of the cylindrical portion 53. The disk 56 is placed concentrically with the hole 55, on one surface of the plate portion 52 which is farther from the cathode 30 than the other surface, and is kept in electrical contact with the cup-shaped electrode 51. Thus, the hole 55 of the plate portion 52 is closed with the disk 56. Like the disk 45, the disk 56 is made of a nonmagnetic material and is smaller in thickness than the plate portion 52. The disk 56 has at a central part thereof a hole 57 which is far smaller in diameter than the hole 55 of the plate portion 52 but is not smaller in diameter than the first aperture 46 of the adjacent grid 40. The hole 57 provides a second aperture in the anode 50.

In the present embodiment having the above-mentioned structure, the grid 40 is applied with a positive potential relative to a cathode potential, for example, with a voltage of 5 to 50 volts and the anode 50 is applied with another positive potential relative to the cathode potential, for example, with a voltage of 100 to 500 volts, in order to form a uniform axial field between the grid 40 and the anode 50, that is, to form a laminar flow electron beam having a nearly constant current density. In order to explain the present invention in more detail, let us consider the case where a diode having a pair of parallel plate electrodes is operated in a limited space charge region. When a distance between cathode and anode and an anode potential relative to a cathode potential are expressed by x and E, respectively, an anode current density J is given by the following equation (the so-called Child-Langmuir equation):

$$J = 2.335 \times 10^{-6} \frac{E^{\frac{3}{2}}}{x^2} \text{ (amp/unit area)} \quad \text{(I)}$$

Equation (I) is also called the three-halves power low. For a system in which the anode current density is kept constant, the following formula is obtained:

$$x \propto E^{\frac{3}{4}} \text{ or } E \propto x^{\frac{4}{3}} \quad \text{(II)}$$

Figure 5:
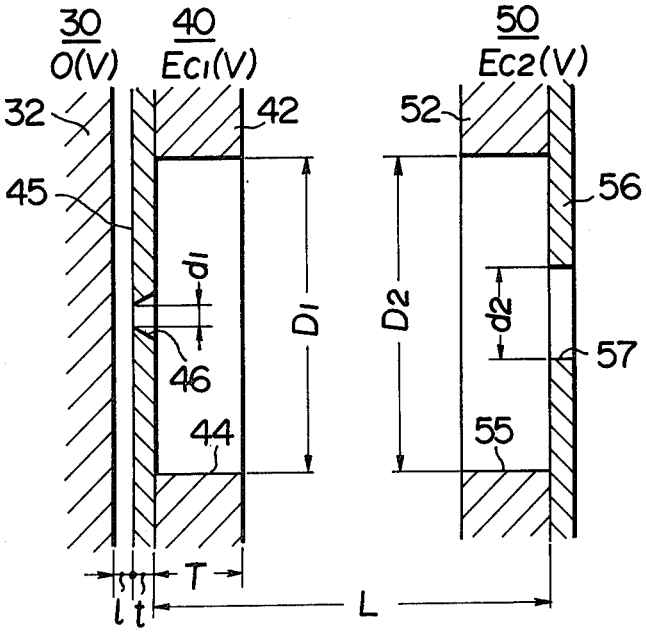
FIG. 5 is an enlarged sectional view of a main part of the embodiment shown in FIG. 4.

When a laminar flow electron beam is formed in the embodiment shown in FIG. 4, the current density J is kept constant. Referring to FIG. 5, when the cathode 30, grid 40 and anode 50 are applied with potentials of 0 volt, $E_{c1}$ volts and $E_{c2}$ volts, respectively, in a state that the current density J is kept constant, and when a distance between the cathode 30 and the first aperture 46 of the grid 40 (corresponding to a distance in FIG. 4 between the cathode end 32 and the disk 45 of the grid 40) and a distance between the first aperture 46 of the grid 40 and the second aperture 57 of the anode 50 (corresponding to a distance in FIG. 4 beween the disk 45 of the grid 40 and the disk 56 of the anode 50) are expressed by l and L, respectively, the following formula is obtained from the formula II:

$$\frac{l+L}{l} = \left(\frac{E_{c2}}{E_{c1}}\right)^{\frac{3}{4}} \text{ or } \frac{E_{c2}}{E_{c1}} = \left(\frac{l+L}{l}\right)^{\frac{4}{3}} \quad \text{(III)}$$

Accordingly, in the present invention, the potentials $E_{c1}$ and $E_{c2}$ and the distance l and L are set so that the above-mentioned formula (III) is satisfied.

Next, explanation will be made on several examples of an electron gun according to the present invention, in comparison with the conventional electron gun.

In FIG. 5 which is an enlarged sectional view of a main part of the embodiment shown in FIG. 4, reference character T designates a thickness of the plate portion 42 of the grid 40, $D_1$, a diameter of the hole 44, t a thickness of the disk 45, $d_1$ a diameter of the hole 46 (namely, the first aperture) on the cathode side, $D_2$ a diameter of the hole 55 made in the plate portion 52 of the anode 50, and $d_2$ a diameter of the hole 57 (namely, the second aperture) made in the disk 56. The thickness of the plate portion 52 and that of the disk 56 are made nearly equal to the thickness T of the plate portion 42 and the thickness t of the disk 45, respectively.

The following table 1 shows dimensions and characteristics of examples ①, ②, ③, ④ and ⑤ of an electron gun according to the present invention and similar dimensions and characters of an example of the conventional electron gun. In more detail, the dimensions include the distances l and L, the diameters $d_1$ and $d_2$, and a ratio $(d_1-d_2)/L$, and the characteristics include a beam current $i_A$, an amplitude response $AR_{ce}$ at the center, and a resolution uniformity OVS/AR/ $_{co}$OVS/AR/ $_{ce}$.

TABLE 1

| | l (mm) | L (mm) | $d_1$ (mm) | $d_2$ (mm) | $\frac{d_1-d_2}{L}$ | $i_S$ (μA) | $AR_{ce}$ (arbitrary unit) | $\frac{\overline{AR}_{co}}{AR_{ce}}$ |
|---|---|---|---|---|---|---|---|---|
| Conventional example | 0.1 | 2.59 | 0.018 | — | — | 2.5 | 2.1 | 0.14 |
| Example 1 | 0.1 | 1.52 | 0.040 | 0.1 | 0.039 | 12.6 | 1.9 | 0.67 |
| Example 2 | 0.06 | 2.59 | 0.042 | 0.1 | 0.023 | 13.8 | 1.8 | 0.49 |
| Example 3 | 0.1 | 2.59 | 0.021 | 0.14 | 0.046 | 3.4 | 2.2 | 0.43 |
| Example 4 | 0.1 | 2.59 | 0.025 | 0.3 | 0.104 | 4.8 | 1.8 | 0.18 |
| Example 5 | 0.2 | 2.98 | 0.022 | 0.1 | 0.027 | 3.8 | 2.2 | 0.54 |

As regards dimensions other than those shown in Table 1, the parameters t, T. $D_1$ and $D_2$ are made equal to 0.03 mm, 0.18 mm, 0.9 mm and 0.9 mm, respectively, for the conventional example and examples ①, ②, ③ and ④, and are made equal to 0.03 mm, 0.12 mm, 0.65 mm and 0.65 mm, respectively, for the example ⑤. As regards operating potentials, the cathode potential, grid potential $E_{c1}$ and anode potential $E_{c2}$ are made equal to 0 V, 5 to 30 V and 150 to 300 V, respectively, for all of the conventional example and examples ①, ②, ③, ④ and ⑤ to form a laminar flow electron beam.

Figure 6:
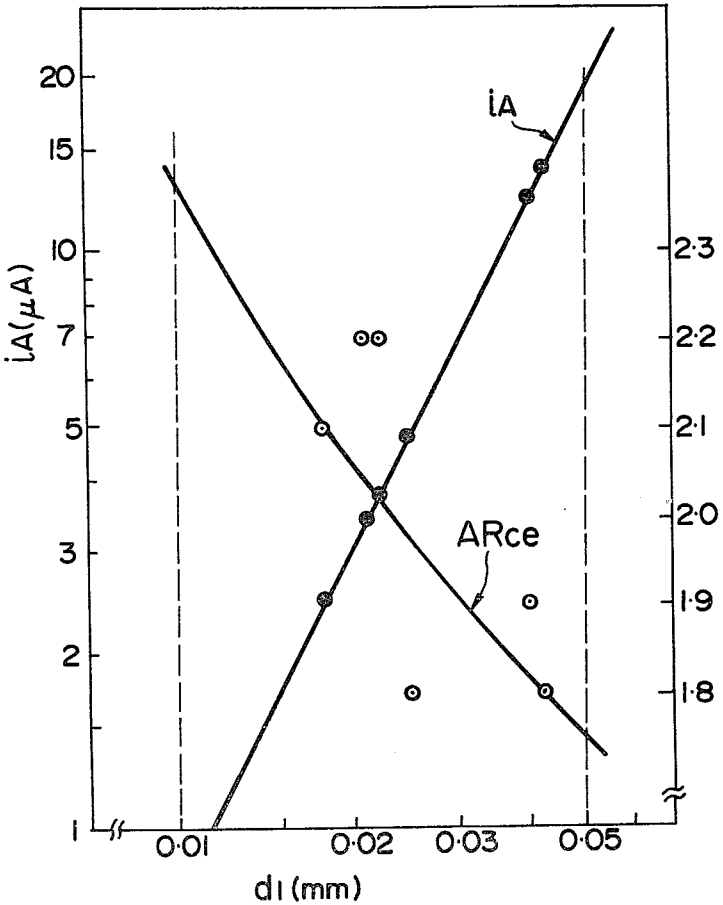

Now, explanation will be made on the characteristics and effects obtained by the present invention, with reference to Table 1. The beam current $i_A$ and the amplitude response $AR_{ce}$ at the center will be first explained. The beam current $i_A$ is herein defined as a current passing through the first aperture 46 of the grid 40 for a cathode loading of 1 A/cm², and the amplitude response $AR_{ce}$ at the center generally corresponds to the resolution. The values in Table 1 are plotted in FIG. 6 with the diameter $d_1$ of the first aperture 46 as abscissa and the beam current $i_A$ and amplitude response $AR_{ce}$ at the center as ordinate. In FIG. 6, black dots indicate the beam current $i_A$, and circles the amplitude response $AR_{ce}$ at the center. As is apparent from FIG. 6, the beam current $i_A$ increases in direct proportion to the diameter $d_1$ of the first aperture, and the amplitude response $AR_{ce}$ at the center decreases in inverse proportion to the diameter $d_1$. In order to operate an ordinary vidicontype camera tube, it is required to generate a beam current of tens of microamperes at the greatest. Accordingly, it is desirable to make large the diameter $d_1$ of the first aperture. However, when the diameter $d_1$ of the first aperture is made large to increase the beam current, the amplitude response $AR_{ce}$ at the center is reduced and therefore it is impossible to obtain a satisfactory resolution. On the other hand, the beam current can be increased by making the current density large. However, a thermionic cathode has a limited electron emitting capability (namely, a limited current density). In order that the cathode performs a stable electron emission, the current density is required to be smaller than about 0.5 A/cm² for an oxide cathode and smaller than about 2 A/cm² for an impregnated cathode. Accordingly, a preferable range is determined for the diameter $d_1$ of the first aperture. In the present invention, when the diameter $d_1$ has a value given by a relation $0.01\text{ mm} \leqq d_1 \leqq 0.05\text{ mm}$, a beam current necessary to operate the camera tube is formed and a satisfactory resolution is obtained.

Next, the resolution uniformity OVS/AR/ $_{co}$/$AR_{ce}$ will be explained. The resolution uniformity OVS/AR $_{co}$/$AR_{ce}$ is a ratio of an amplitude response (namely, a resolution) OVS/AR/ $_{co}$ at corners on scan area to an amplitude response (namely, a resolution) $AR_{ce}$ at the center on scan area.

The resolution of a television camera tube is closely connected with the spot size of the electron beam incident on a photoconductive target, and is high as the spot size is smaller. However, an attainable minimum diameter of a focused electron beam is determined by the thermal velocity distribution of electrons, the space charge effect and the spherical aberration of a focusing system.

In a television camera tube, a spot diameter $D_{ce}$ at the center on scan area is determined mainly by the thermal velocity distribution of electrons and the spherical aberration because of a small beam current. Further, since a divergent beam angle at the exit of the electron gun is small, the thermal velocity distribution of electrons has a great influence upon the spot diameter $D_{ce}$ at the center on scan area, and therefore the spot diameter $D_{ce}$ is determined substantially by the thermal velocity distribution. A spot diameter $D_L$ resulting from the thermal velocity distribution is given by the following Langmuir equation:

$$D_L = 2\sqrt{\frac{i_B}{\pi\rho_c\left(1+\frac{eV}{kT_K}\right)}} \times \frac{1}{\sin\theta} \quad \text{(IV)}$$

where $\rho_c$ indicates a current density at cathode, $T_K$ a cathode temperature, $\theta$ a convergent beam angle at focal point (which is nearly equal to a divergent beam angle at the exit of electron gun since the angular magnification of the main lens system in a television camera tube is nearly equal to 1), V a potential at focal point, $i_B$ a beam current, k the Boltzmann's constant, and e the electronic charge. As can be seen from Equation IV, the spot diameter $D_{ce}$ at the center is in substantially inverse proportion to the divergent beam angle at the exit of electron gun. On the other hand, a spot diameter $D_{co}$ at corners on scan area is larger than the spot diameter $D_{ce}$ at the center due to the deflective aberration of a deflecting system. The deflective aberration has a tendency to increase in direct proportion to the divergent beam angle at the exit of electron gun (or the square of the divergent beam angle).

Accordingly, a ratio of the spot diameter at corners on scan area to the spot diameter at the center increases in proportion to the divergent beam angle at the exit of electron gun.

That is, $$\frac{D_{co}}{D_{ce}} \text{ (divergent beam angle)}^2 \quad \text{(V)}$$

The divergent beam angle is a characteristic of electron gun. However, when the scattered electrons generating at the grid are also taken into consideration, the divergent beam angle is nearly equal to an angle $\tan^{-1}(d_2-d_1)/2L$, which is determined by the diameter $d_1$ of the first aperture in the grid, the diameter $d_2$ of the second aperture in the anode and the distance L between the first and second apertures. Accordingly, the following relation between the spot diameters is obtained from the formula V:

$$\frac{D_{co}}{D_{ce}} \propto \left(\frac{d_2-d_1}{L}\right)^2 \quad \text{(VI)}$$

Since the amplitude response (namely, resolution) decreases in substantially inverse proportion to the spot diameter, it is expected that the resolution uniformity $OVS/AR/_{co}/AR_{ce}$ is given by the following formula:

$$\frac{\overline{AR}_{co}}{AR_{ce}} \propto \left(\frac{d_2-d_1}{L}\right)^{-2} \quad \text{(VII)}$$

and the resolution uniformity is inversely proportional to the parameter $(d_2-d_1)/L$.

Figure 7:
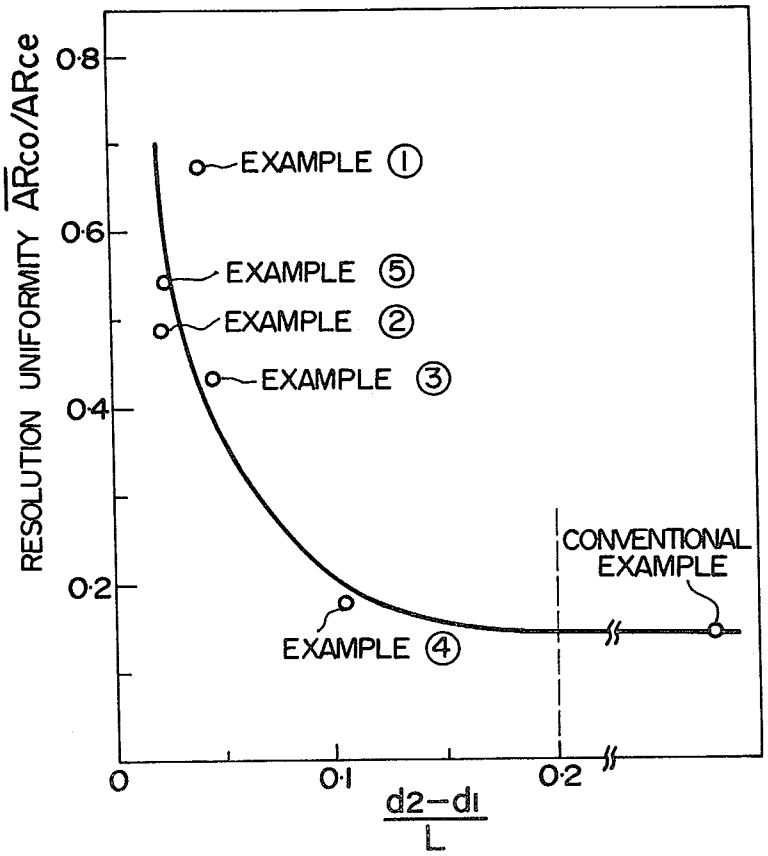
FIGS. 6 and 7 are graphs for explaining various characteristics of electron guns according to the present invention.

The values in Table 1 are plotted in FIG. 7 with the parameter $(d_2-d_1)/L$ as abscissa and the resolution uniformity $OVS/AR/_{co}/AR_{ce}$ as ordinate. As is apparent from FIG. 7, the resolution uniformity decreases in inverse proportion to the parameter $(d_2-d_1)/L$, and substantially satisfies the formula VII. Accordingly, it is desired that the parameter $(d_2-d_1)/L$ is made small appropriately to obtain a high resolution uniformity. In order to attain a resolution uniformity which is higher than that of the conventional example, it is preferable to make an upper limit of parameter $(d_2-d_1)/L$ of an electron gun according to the present invention equal to 0.2. In more detail, the resolution uniformity is kept substantially unchanged within a range of parameter $(d_2-d_1)/L$ exceeding 0.2, that is, is saturated when the parameter $(d_2-d_1)/L$ becomes equal to 0.14. Accordingly, in order to obtain a resolution uniformity which is high as compared with that of the conventional example, it is desired that the parameter $(d_2-d_1)/L$ in an electron gun according to the present invention has a value given by the following formula:

$$0 \leqq (d_2-d_1)/L \leqq 0.2 \quad \text{(VIII)}$$

As has been explained in the foregoing, according to the present invention, there is provided an electron gun for use in a television camera tube which can generate a beam current necessary to operate the camera tube, improve the amplitude response (namely, resolution) at corners on scan area, remarkably enhance the resolution uniformity over the scan area, and moreover form a laminar flow electron beam without a crossover to make small the lag (namely, the after image).

We claim:

1. An electron gun comprising: a thermionic cathode; a grid having a first aperture; and an anode having a second aperture; said thermionic cathode, said grid and said anode being arranged in the order described, a diameter $d_1$ of said first aperture being smaller than or equal to a diameter $d_2$ of said second aperture, said grid and said anode being applied with predetermined positive potentials to form a uniform axial field between said grid and said anode whereby an electron beam between said grid and said anode is formed with no crossover therebetween; said grid including a first cup-shaped electrode whose bottom portion is arranged near an electron emitting surface of said thermionic cathode and has a hole with a diameter larger than said diameter of said first aperture, and a first disk having said first aperture and electrically connected with said first cup-shaped electrode at a place between said thermionic cathode and said first cup-shaped electrode; and said anode including a second cup-shaped electrode whose bottom portion is arranged near said bottom portion of said grid and has a hole with a diameter larger than said diameter of said second aperture, and a second disk having said second aperture and electrically connected with said second cup-shaped electrode on one side of said second cup-shaped electrode where said thermionic cathode is absent.

2. An electron gun comprising: a thermionic cathode; a grid having a first aperture; and an anode having a second aperture; said thermionic cathode, said grid and said anode being arranged in the order described, a diameter $d_1$ of said first aperture being smaller than or equal to a diameter $d_2$ of said second aperture, said grid and said anode being applied with predetermined positive potentials to form a uniform axial field between said grid and said anode, said diameter $d_1$ of said first aperture, said diameter $d_2$ of said second aperture and a distance L between said first and second apertures being set so as to satisfy the following formula:

$$0 \leqq (d_2-d_1)/L \leqq 0.2.$$

3. An electron gun according to claim 2 or 3, wherein said diameter $d_1$ of said first aperture lies within a range from 0.01 mm to 0.05 mm.

4. An electron gun according to claim 1, wherein said diameter $d_1$ of said first aperture, said diameter $d_2$ of said second aperture and a distance L between said first and second aperture are set so as to satisfy the following formula:

$$0 \leqq (d_2 - d_1)/L \leqq 0.2.$$

5. An electron gun comprising: a thermionic cathode; a grid having a first aperture; and an anode having a second aperture; said grid and said anode being arranged in the order described, said grid and said anode being applied with predetermined positive potentials relative to a cathode potential for forming an electron beam therebetween, said electron beam between said grid and said cathode being formed with no crossover therebetween, a diameter $d_2$ of said second aperture being greater than or equal to a diameter $d_1$ of said first aperture so that only a portion of the electron beam passes through said second aperture.

6. An electron gun according to claim 5, wherein the electron beam between said grid and said anode includes electrons with a large velocity component in a radial direction and electrons with a small velocity component in a radial direction, said second aperture passing only electrons with the small velocity component in a radial direction therethrough.

7. An electron gun according to claim 6, wherein said electron beam is provided with a constant current density between said grid and said anode.

8. An electron gun according to claim 5 or 6 wherein said grid includes a first cup-shaped electrode whose bottom portion is arranged near an electron emitting surface of said thermionic cathode and has a hole with a diameter larger than said diameter of said first aperture, and a first disk having said first aperture and electrically connected with said first cup-shaped electrode at a place between said thermionic cathode and said first cup-shaped electrode; and wherein said anode includes a second cup-shaped electrode whose bottom portion is arranged near said bottom portion of said grid and has a hole with a diameter larger than said diameter of said second aperture, and a second disk having said second aperture and electrically connected with said second cup-shaped electrode on one side of said cup-shaped electrode where said thermionic cathode is absent.

9. An electron gun according to claim 5 or 6, wherein said diameter $d_1$ of said first aperture, said diameter $d_2$ of said second aperture and a distance L between said first and second apertures are set so as to satisfy the following formula:

$$0 \leqq (d_2 - d_1)/L \leqq 0.2.$$

10. An electron gun according to claim 5 or 6, wherein said diameter $d_1$ of said first aperture lies within a range from 0.01 mm to 11. An electron gun comprising: a thermionic cathode; a grid having a first aperture; and an anode having a second aperture; said thermionic cathode; said grid and said anode being arranged in the order described, said grid and said anode being applied with predetermined positive potentials relative to a cathode potential for forming an electron beam therebetween, a diameter $d_2$ of said second aperture being greater than or equal to a diameter $d_1$ of said first aperture so that only a portion of the electron beam passes through said aperture, said diameter $d_1$ of said first aperture, said diameter $d_2$ of said second aperture and a distance L between said first and second apertures are set so as to satisfy the following formula:

$$0 \leqq (d_2 - d_1)/L \leqq 0.2.$$

* * * * *